US011339980B2

(12) United States Patent
Chiu

(10) Patent No.: US 11,339,980 B2
(45) Date of Patent: May 24, 2022

(54) DEHUMIDIFIER WITH A RETRACTABLE CONDUIT

(71) Applicant: NEW WIDETECH INDUSTRIES CO., LTD., New Taipei (TW)

(72) Inventor: Ming-Tsung Chiu, New Taipei (TW)

(73) Assignee: New Widetech Industries Co., LTD, New Taipei (TW)

( * ) Notice: Subject to any disclaimer, the term of this patent is extended or adjusted under 35 U.S.C. 154(b) by 212 days.

(21) Appl. No.: 16/909,102

(22) Filed: Jun. 23, 2020

(65) Prior Publication Data

US 2021/0396401 A1 Dec. 23, 2021

(51) Int. Cl.

| | |
|---|---|
| ***F24F 3/14*** | (2006.01) |
| ***F24F 13/20*** | (2006.01) |
| ***F24F 3/06*** | (2006.01) |
| ***F24F 13/22*** | (2006.01) |

(52) U.S. Cl.

CPC ..... *F24F 3/14* (2013.01); *F24F 3/06* (2013.01); *F24F 13/20* (2013.01); *F24F 13/222* (2013.01); *F24F 2003/144* (2013.01)

(58) Field of Classification Search

CPC .... F24F 3/14; F24F 3/06; F24F 3/1405; F24F 13/20; F24F 13/222; F24F 2003/144; F24F 2003/1446; F24F 2013/227

See application file for complete search history.

(56) References Cited

U.S. PATENT DOCUMENTS

| | | | | |
|---|---|---|---|---|
| 11,226,118 | B1 * | 1/2022 | Rodriguez | F24F 1/029 |
| 2010/0000242 | A1 * | 1/2010 | Chiu | F24F 1/022 62/150 |
| 2015/0184875 | A1 * | 7/2015 | Lee | F24F 13/222 62/93 |
| 2015/0241072 | A1 * | 8/2015 | Kim | F24F 1/0323 236/44 C |
| 2016/0131372 | A1 * | 5/2016 | Choi | F24F 3/1405 62/189 |
| 2017/0045241 | A1 * | 2/2017 | Chiu | F24F 13/20 |
| 2018/0071676 | A1 * | 3/2018 | Sakikawa | B01J 20/3425 |
| 2019/0212018 | A1 * | 7/2019 | Kim | F24F 13/06 |
| 2019/0368771 | A1 * | 12/2019 | Yoon | F24F 13/24 |
| 2019/0376701 | A1 * | 12/2019 | Jeong | F28F 1/30 |
| 2020/0003451 | A1 * | 1/2020 | Yoon | F24F 13/10 |
| 2020/0011551 | A1 * | 1/2020 | Williams | F24F 1/04 |
| 2020/0061531 | A1 * | 2/2020 | Yoon | F24F 13/20 |

(Continued)

FOREIGN PATENT DOCUMENTS

| | | | | |
|---|---|---|---|---|
| JP | 2017053582 A * | 3/2017 | | F24F 3/14 |

*Primary Examiner* — Nelson J Nieves

(74) *Attorney, Agent, or Firm* — Rosenberg, Klein & Lee

(57) ABSTRACT

A dehumidifier has a main body and a main tank. The main body has a secondary tank, a pump, and a retracting mechanism. A conduit portion of the retracting mechanism is mounted through and into the main tank, so the pump can draw water from the secondary tank and into the main tank. The main tank is mounted beside the main body and can be drawn upward to separate from the main body. The main tank has a first inclined surface. When the main tank is moved upward, the first inclined surface pushes the retracting mechanism, so the conduit portion retracts and is moved away from a moving path of the main tank when the main tank is being drawn upward. With the main tank mounted beside the main body, the main tank facilitates water pouring.

13 Claims, 11 Drawing Sheets

(56) References Cited

U.S. PATENT DOCUMENTS

| | | | | |
|---|---|---|---|---|
| 2020/0271336 | A1* | 8/2020 | Huang | F24F 3/14 |
| 2020/0300531 | A1* | 9/2020 | Barlettano | F24F 13/16 |
| 2020/0309391 | A1* | 10/2020 | Ma | F24F 1/022 |
| 2020/0309405 | A1* | 10/2020 | Jang | F24F 1/0011 |

* cited by examiner

DEHUMIDIFIER WITH A RETRACTABLE CONDUIT

BACKGROUND OF THE INVENTION

1. Field of the Invention

The present invention relates to a home appliance, especially to a dehumidifier.

2. Description of the Prior Arts

An operating principle of a dehumidifier is basically the following: air is drawn into the dehumidifier from the environment via a fan, and then the air passes through a heat exchanger, and thereby moisture in the air is condensed into water drops. The water drops then drip into a tank. Therefore, the air that becomes dry and hot is exhausted out of the dehumidifier, so the humidity of the space is decreased.

Under the aforesaid operating principle and the gravity, in conventional dehumidifiers, the tank must be mounted under a radiator of the heat exchanger, so that the water drops dripping from the radiator can be received by the tank. In other words, the tank is arranged at a bottom part of the dehumidifier and must be separated from a main body of the dehumidifier laterally. However, after the tank is full, the user has to bend down to withdraw the tank laterally, then lifts up the tank.

Because such structure makes it hard to separate the tank and the main body of the dehumidifier and the full tank is heavy, the aforesaid movement may injure the user's waist or cause the tank to be turned over.

To overcome the shortcomings, the present invention provides a DEHUMIDIFIER WITH A RETRACTABLE CONDUIT to mitigate or obviate the aforementioned problems.

SUMMARY OF THE INVENTION

The main objective of the present invention is to provide a DEHUMIDIFIER WITH A RETRACTABLE CONDUIT that has a tank laterally mounted on a main body and the tank can be separated from the main body by upward withdrawing. Besides, with a retracting mechanism and an inclined surface of the tank interacting with each other, a conduit portion can move away from a moving path of the tank as the tank is separated from the main body, and back to the tank after the tank is mounted on the main body.

The dehumidifier has a main body and a main tank. The main body has a radiator, a water collector, a secondary tank, a pump, a partition wall, and a retracting mechanism. The water collector is located under and aligned with the radiator and forms an exhaust hole. The secondary tank is located under the water collector and forms a receiving hole and a secondary storage. The receiving hole is aligned with the exhaust hole and the secondary storage space communicates with the receiving hole. The pump has a drawing end and a draining end. The drawing end communicates with the secondary storage space. The partition wall has a first surface and a second surface opposite the first surface. The retracting mechanism has a retractable component and an elastic component. The retractable component is movably mounted on the first surface of the partition wall and has an abutting portion and a conduit portion. The abutting portion selectively passes through the partition wall. The conduit portion selectively passes through the partition wall. The conduit portion communicates with the draining end of the pump. The elastic component is connected to the retractable component to facilitate the abutting portion and the conduit portion to pass through and out of the partition wall. The main tank is detachably mounted on the main body and located beside the second surface of the partition wall of the main body. The main tank is capable of being moved upward with respect to the main body, thereby being detached from the main body. The main tank has a main storage space, a side wall, and a first inclined portion. The side wall faces the partition wall of the main body and has a third surface and a through hole. The third surface faces the partition wall. The through hole communicates with the main storage space. The conduit portion of the retractable component selectively passes through the through hole and into the main storage space. The first inclined portion is formed on the third surface of the side wall. The first inclined portion is bottom-up progressively away from the partition wall. When the main tank is moved upward with respect to the main body and the first inclined portion abuts the abutting portion of the retractable component, the first inclined portion pushes the abutting portion of the retractable component away from the partition wall and thereby the conduit portion of the retractable component is progressively retracted from the main storage space and the through hole of the main tank.

With the secondary tank located under the water collector, the secondary tank can temporally receive the dripping water. With the conduit portion of the retracting component passing through the through hole of the side wall of the main tank and thus into the storage space of the main tank, and the draining end of the pump and the draining end of the pump communicating with the conduit portion, the pump can draw the water from the secondary tank to the main tank. Therefore, the main tank may not be restricted by the gravity which restricts the main tank to be mounted at a lower end of a dehumidifier. As a result, the main tank can be mounted beside the main body and can be extracted with a vertical force, so the present invention facilitates ease in operating, avoids the main tank to be turned over, and avoids injuring a user's waist.

Moreover, with the first inclined portion formed on the third surface of the side wall, and with the first inclined portion corresponding to the abutting portion, when the user lifts up the main tank to move upward with respect to the main body, the first inclined portion can abut the abutting portion and slide with respect to the abutting portion. Because the first inclined portion is bottom-up progressively away from the partition wall, when the first inclined portion is moved upward with respect to the abutting portion, the first inclined portion progressively abuts the abutting portion via a portion thereof that is closer to the partition wall. In other words, because the first inclined portion abuts the abutting portion, the retractable component is moved away from the partition wall, and thereby the conduit portion is moved out of the main storage space and the through hole. Therefore, after the main tank is mounted on the main body, the conduit portion can be located in the main tank and moved away from the moving path of the main tank while the main tank is separated from the main body.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
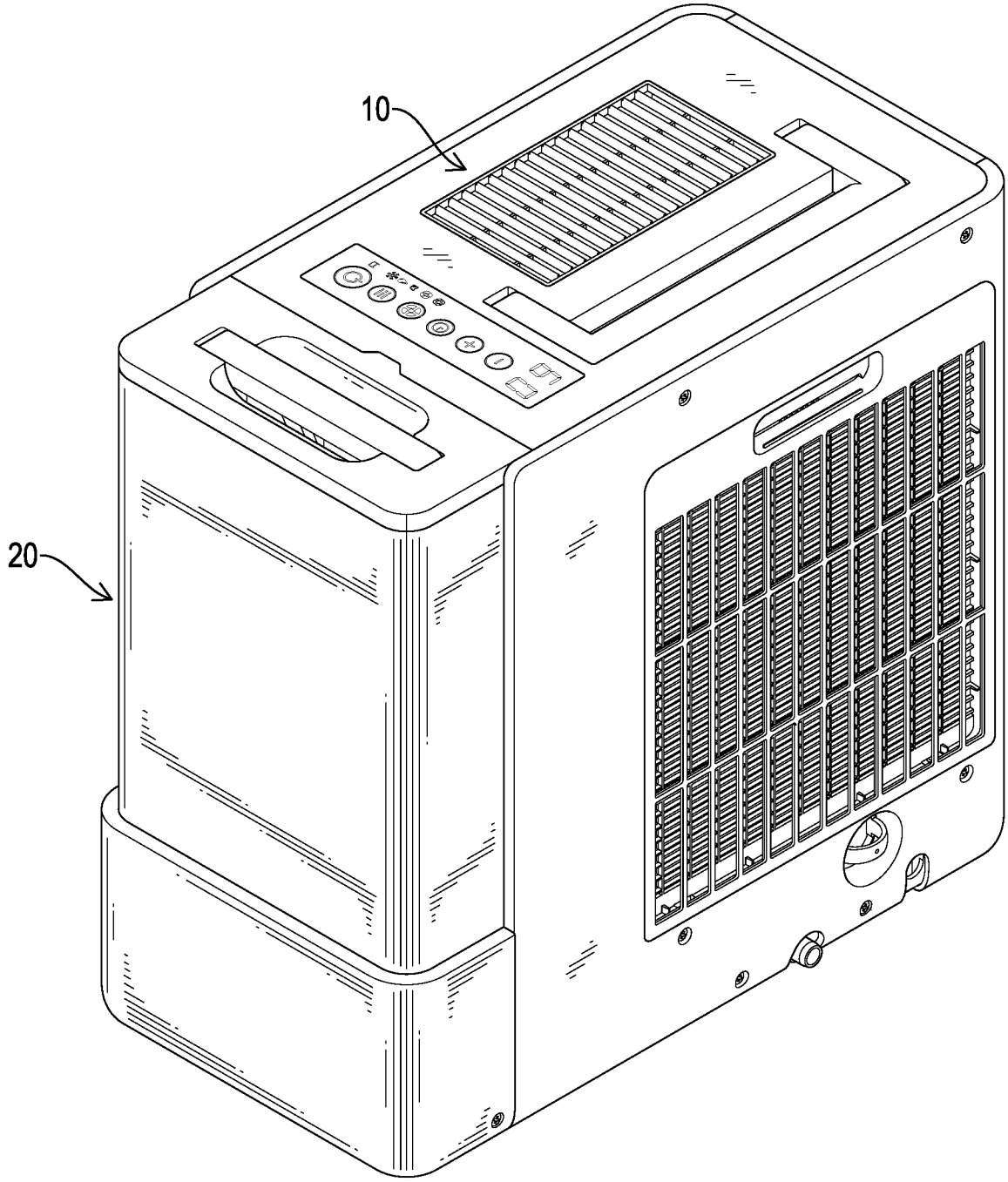
FIG. 1 is a perspective view of a dehumidifier in accordance with the present invention.
Figure 2:
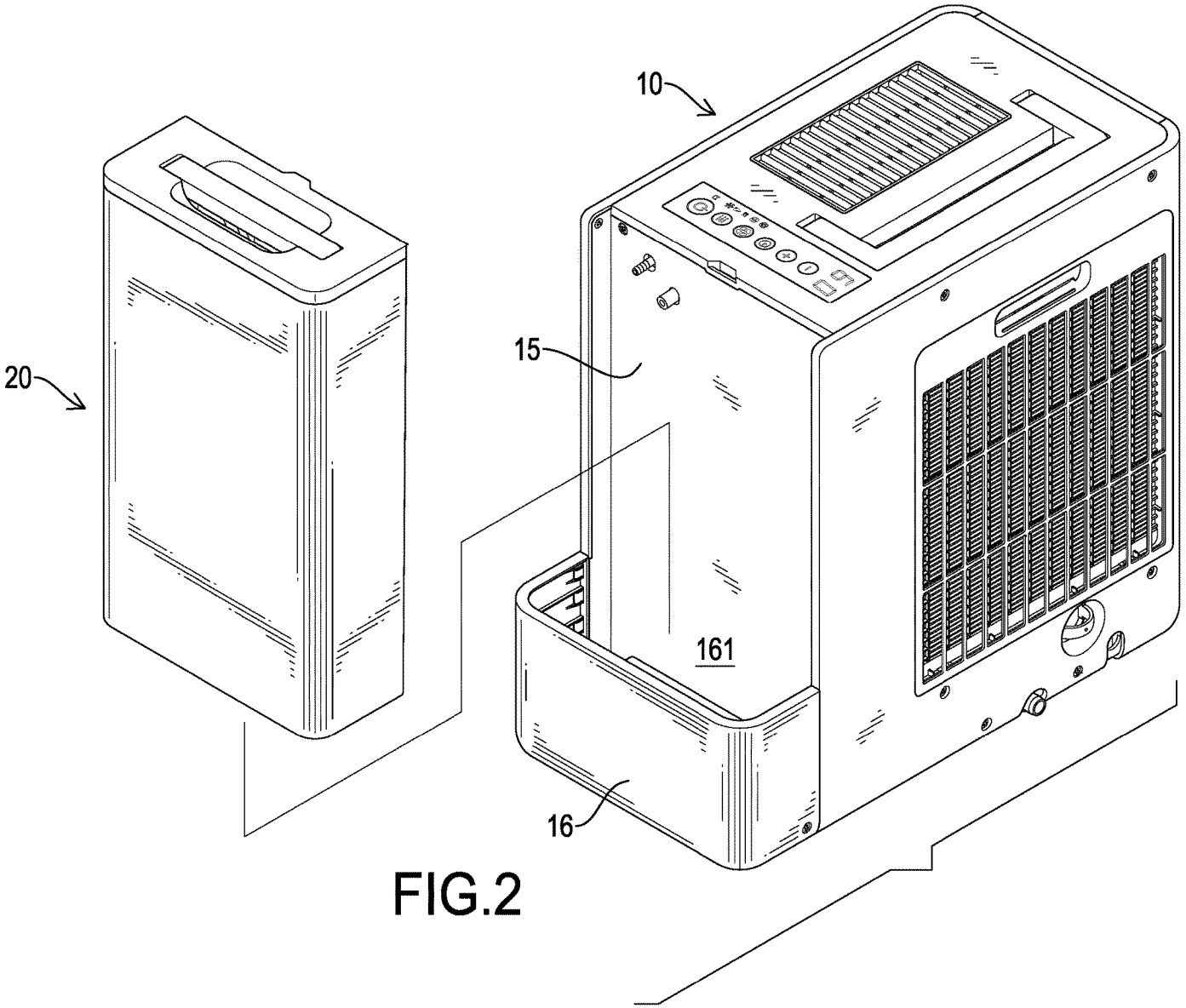
FIG. 2 is a perspective view of the dehumidifier in FIG. 1, showing a main tank detached from a main body.

With reference to FIG. 1 and FIG. 2, a dehumidifier with a retractable conduit is provided in accordance with the present invention. The dehumidifier comprises a main body 10 and a main tank 20.

Figure 3:
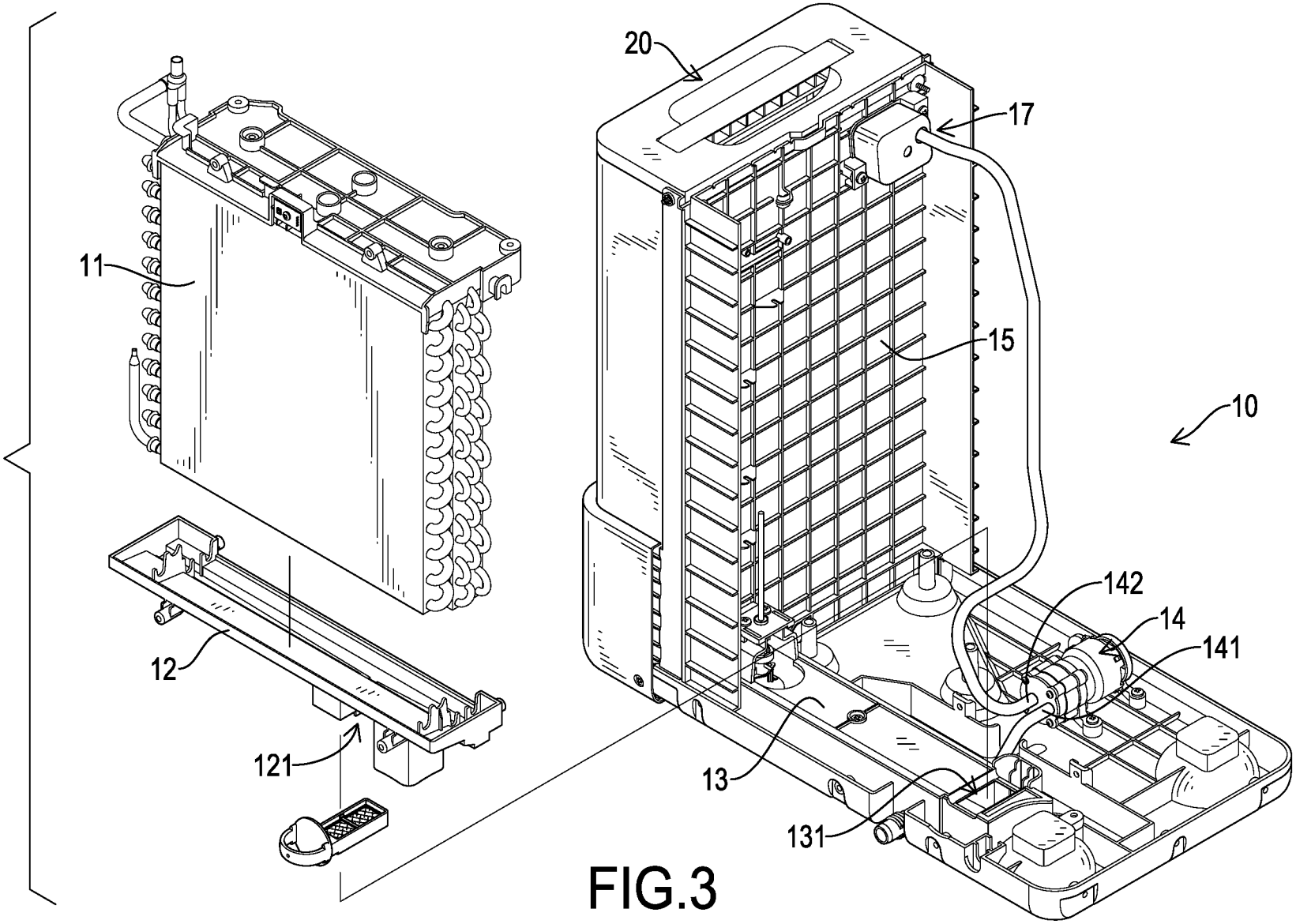
FIG. 3 is an exploded view of the dehumidifier in FIG. 1.
Figure 4:
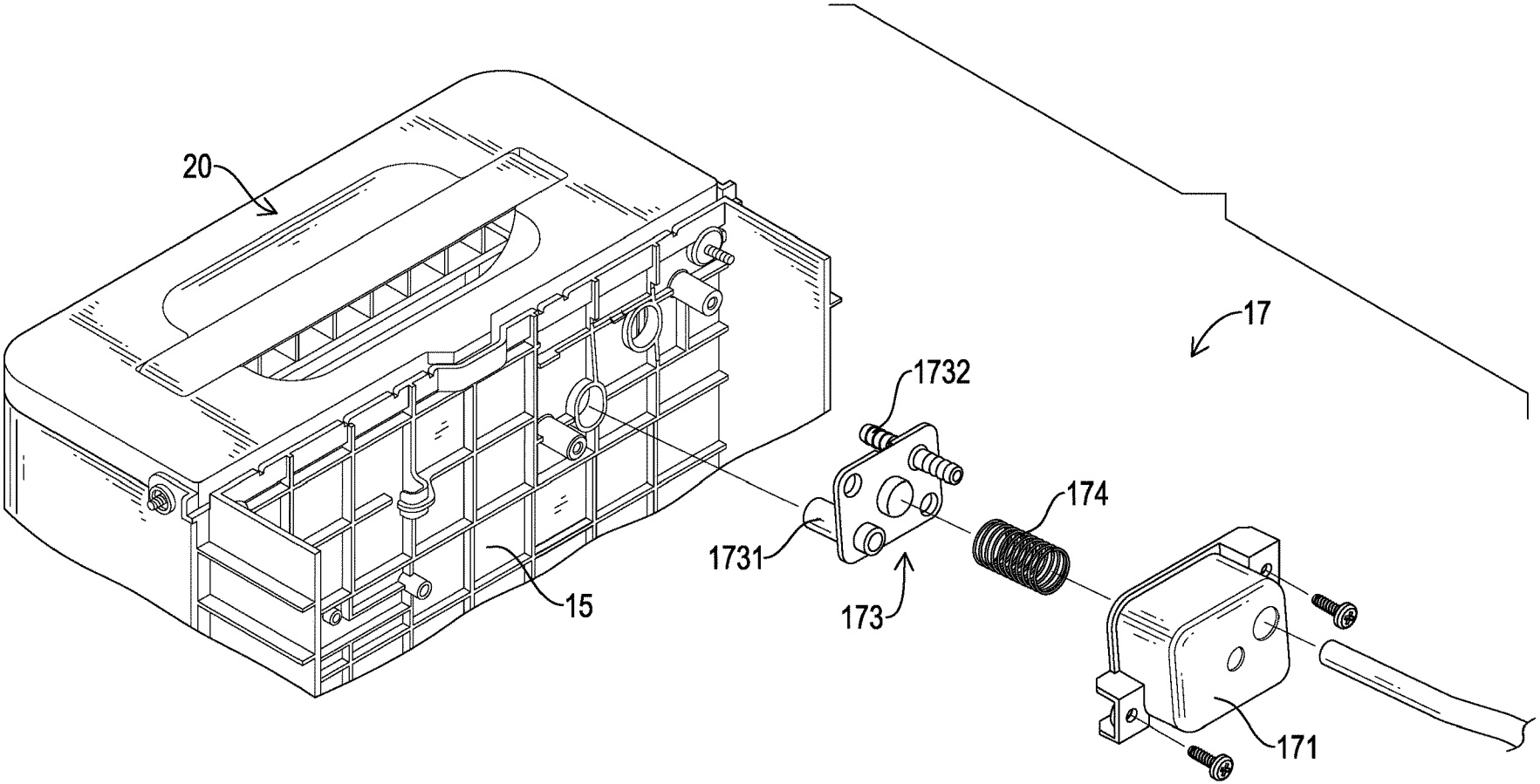
FIG. 4 is an exploded view of a retracting mechanism of the dehumidifier in FIG. 1.

Please also refer to FIG. 3 and FIG. 4. The main body 10 includes a radiator 11, a water collector 12, a secondary tank 13, a pump 14, a partition wall 15, an enclosing wall 16, and a retracting mechanism 17.

The radiator 11 is configured to exchange heat with air so that the moisture in the air is condensed into water droplets. The water collector 12 is mounted under and aligned with the radiator 11 and includes an exhaust hole 121. The secondary tank 13 is mounted under the water collector 12 and includes a receiving hole 131 and a secondary storage space communicating with each other. The receiving hole 131 faces the exhaust hole 121 of the water collector 12. The pump 14 includes a drawing end 141 and a draining end 142. The drawing end 141 communicates with the secondary storage space of the secondary tank 13. The draining end 142 connects to the retracting mechanism 17. The partition wall 15 includes a first surface and a second surface opposite each other. The enclosing wall 16 is connected to the partition wall 15 and mounted on the second surface, and the enclosing wall 16 and the partition wall 15 enclose a receiving space 161 together. Precisely, the partition wall 15 is part of the main body 10 and is located beside the retracting mechanism 17. The first surface of the partition wall 15 is located in the housing 171. In this embodiment, the radiator 11, the water collector 12, the secondary tank 13, the pump 14, and the retracting mechanism 17 are located beside the first surface of the partition wall 15, but the enclosing wall 16 is located beside the second surface of the partition wall 15.

Figure 5:
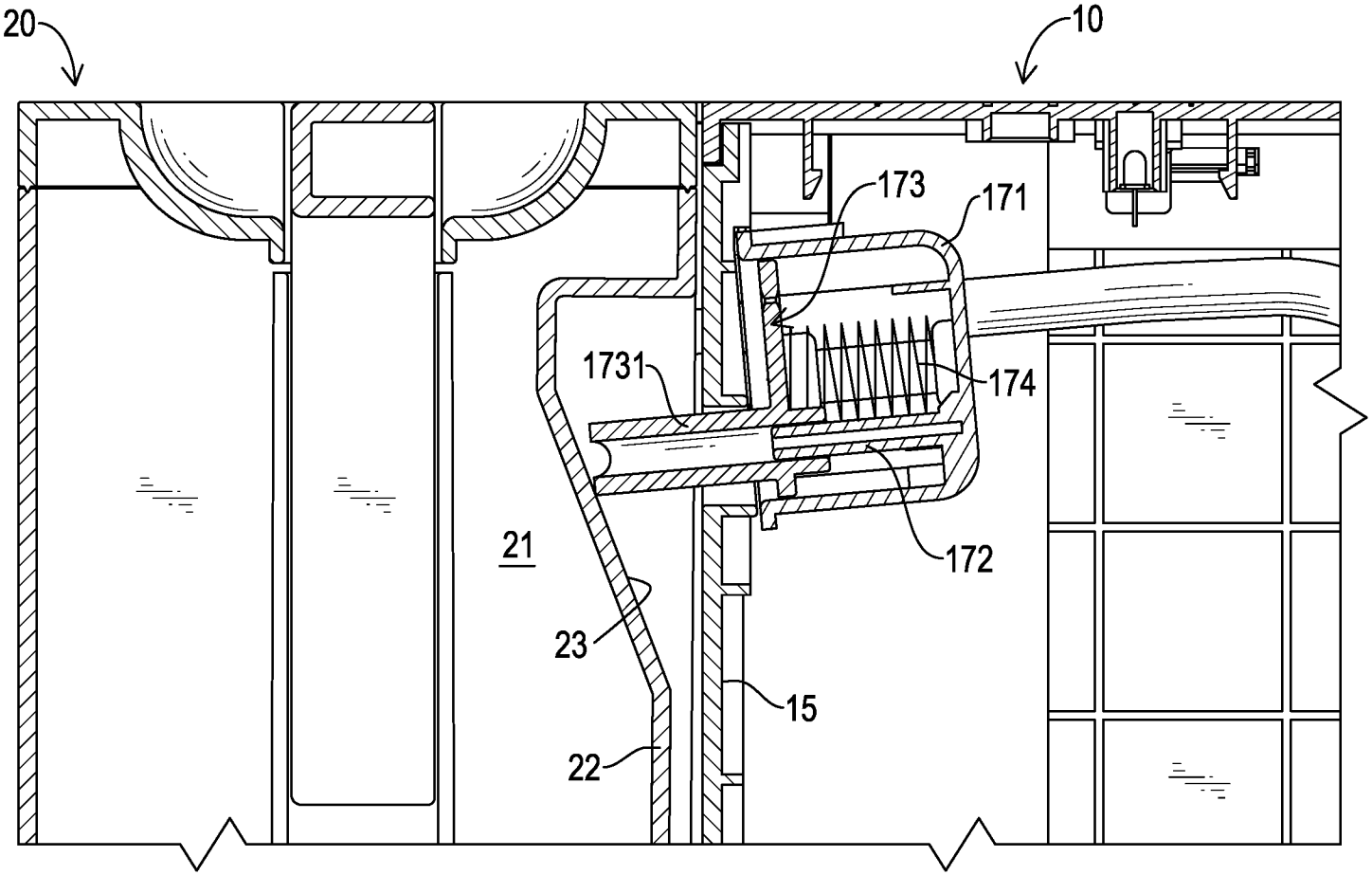
FIG. 5 is a sectional view of the retracting mechanism and the main tank in FIG. 1.
Figure 6:
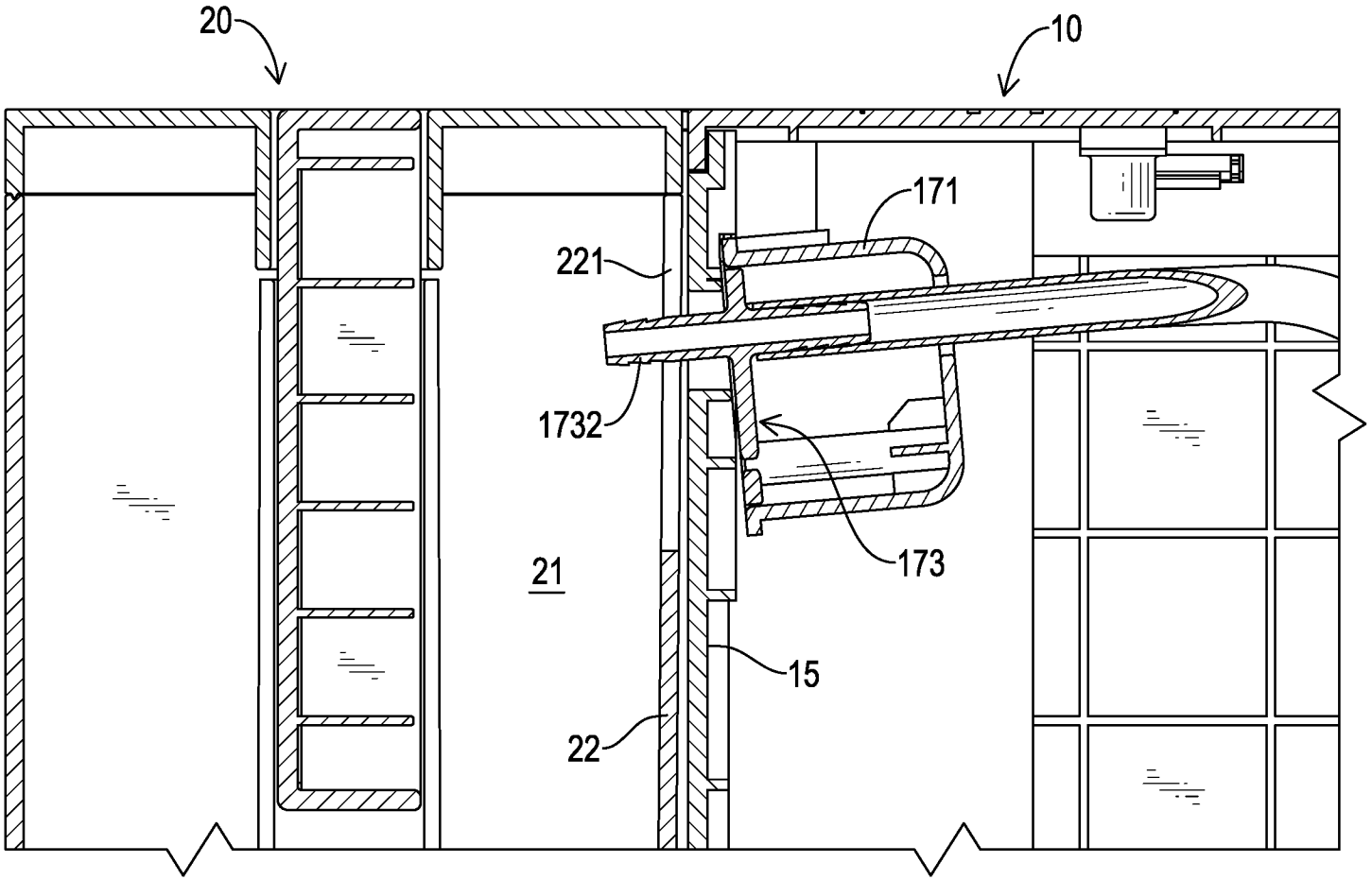
FIG. 6 is another sectional view of the retracting mechanism and the main tank in FIG. 1.

Please also refer to FIG. 4, FIG. 5, and FIG. 6. In this embodiment, the retracting mechanism 17 includes a housing 171, a positioning component 172, a retractable component 173, and an elastic component 174. In addition, in this embodiment, the retractable component 173 is retracted via moving, but in another embodiment, the retractable component 173 is retracted via rotating, so the structure of the retracting mechanism 17 is not limited thereto.

The housing 171 is mounted on the first surface of the partition wall 15 and includes an inner space and a communicating opening. The communicating opening communicates with the inner space and faces the partition wall 15. The positioning component 172 is mounted on the housing 171 and in the inner space. The retractable component 173 is movably mounted on the first surface of the partition wall 15. Precisely, the retractable component 173 is capable of being moved toward or away from the partition wall 15. In this embodiment, the retractable component 173 is capable of being moved in the inner space of the housing 171, sleeved on the positioning component 172, and moved along the positioning component 172. The retractable component 173 includes an abutting portion 1731 and a conduit portion 1732. The abutting portion 1731 selectively runs through the partition wall 15. The conduit portion 1732 selectively runs through the partition wall 15 and communicates with the draining end 142 of the pump 14. The elastic component 174 is connected to the retractable component 173, thereby facilitating the abutting portion 1731 and the conduit portion 1732 of the retractable component 173 to run through the partition wall 15. In this embodiment, the elastic component 174 abuts and connects the housing 171 and the retractable component 173, thereby facilitating the abutting portion 1731 and the conduit portion 1732 of the retractable component 173 to run out of the communicating opening of the housing 171. As long as the retractable component 173 is capable of moving toward and away from the partition wall 15 and the elastic component 174 is capable of driving the retractable component 17 to move toward the partition wall 151, the structure of the retracting mechanism 17 is not limited thereto.

Besides, in this embodiment, the moving path of the retractable component 173 is a straight line and is oblique relative to the partition wall 15. Precisely, the moving path of the retractable component 173 is inclined downwardly in a direction toward the partition wall 15. Therefore, a lower end of the conduit portion 1732 runs through the partition wall 15, and thereby water flowing out of the lower end of the conduit portion 1732 may not flow back toward the first surface of the partition wall 15; but it is not limited thereto. In other words, the moving path of the retractable component 173 may not be inclined downward, but instead, the end, running out of the partition wall 15, of the conduit portion 1732 is bent downward.

Please also refer to FIGS. 5 to 9. The main tank 20 is detachably mounted on the main body 10 and located beside the main body 10. Precisely, the main tank 20 is mounted on the second surface of the partition wall 15. The main tank 20 is capable of being moved with respect to the main body 10 and thus separated from the main body 10. In this embodiment, the main tank 20 can be moved upward, thereby being detached from the receiving space 161 enclosed by the partition wall 15 and the enclosing wall 16. In this embodiment, the main tank 20 includes a main storage space 21, a side wall 22, a first inclined portion 23, a second inclined portion 24, and a retracting recess 25.

The side wall 22 parallelly faces the partition wall 15 of the main body 10 and includes a third surface and a through hole 221. The third surface of the side wall 22 faces the partition wall 15. The through hole 221 communicates with the main storage space 21. The conduit portion 1732 selectively runs into the main storage space 21 via the through hole 221.

Figure 7:
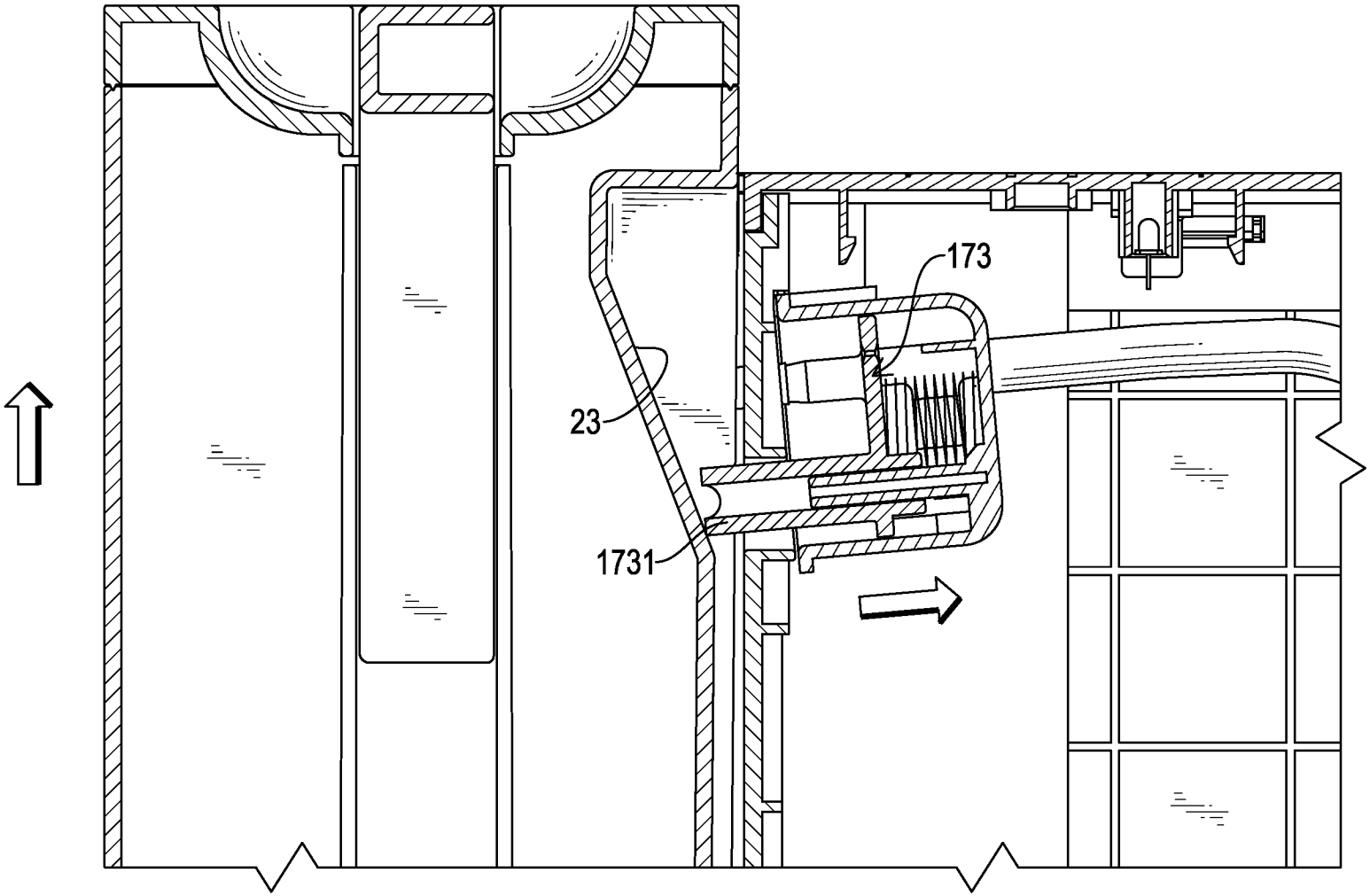
FIG. 7 is another sectional view of the retracting mechanism and the main tank in FIG. 5, showing the main tank being drawn upward.
Figure 8:
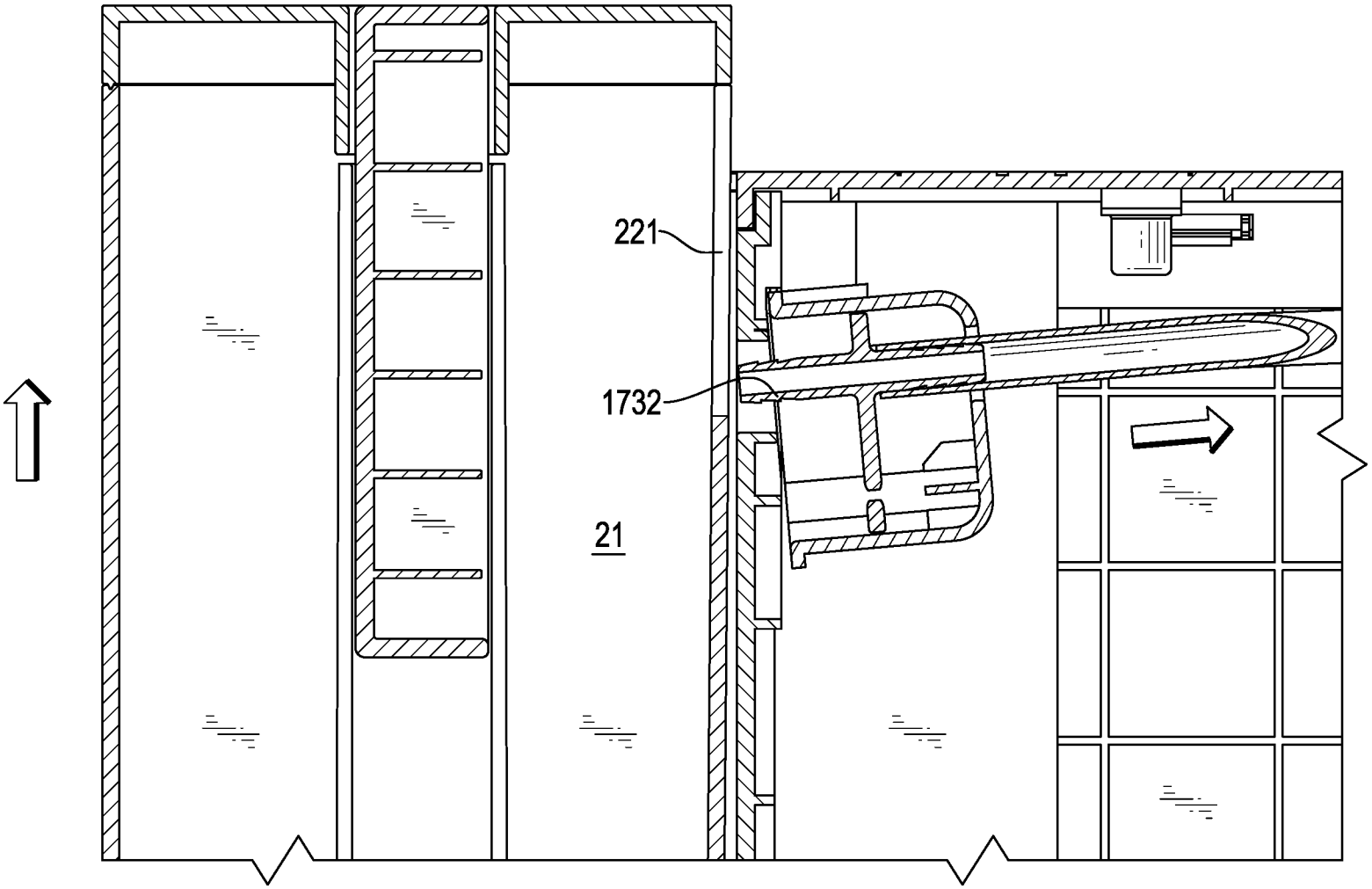
FIG. 8 is another sectional view of the retracting mechanism and the main tank in FIG. 6, showing the main tank being drawn upward.
Figure 9:
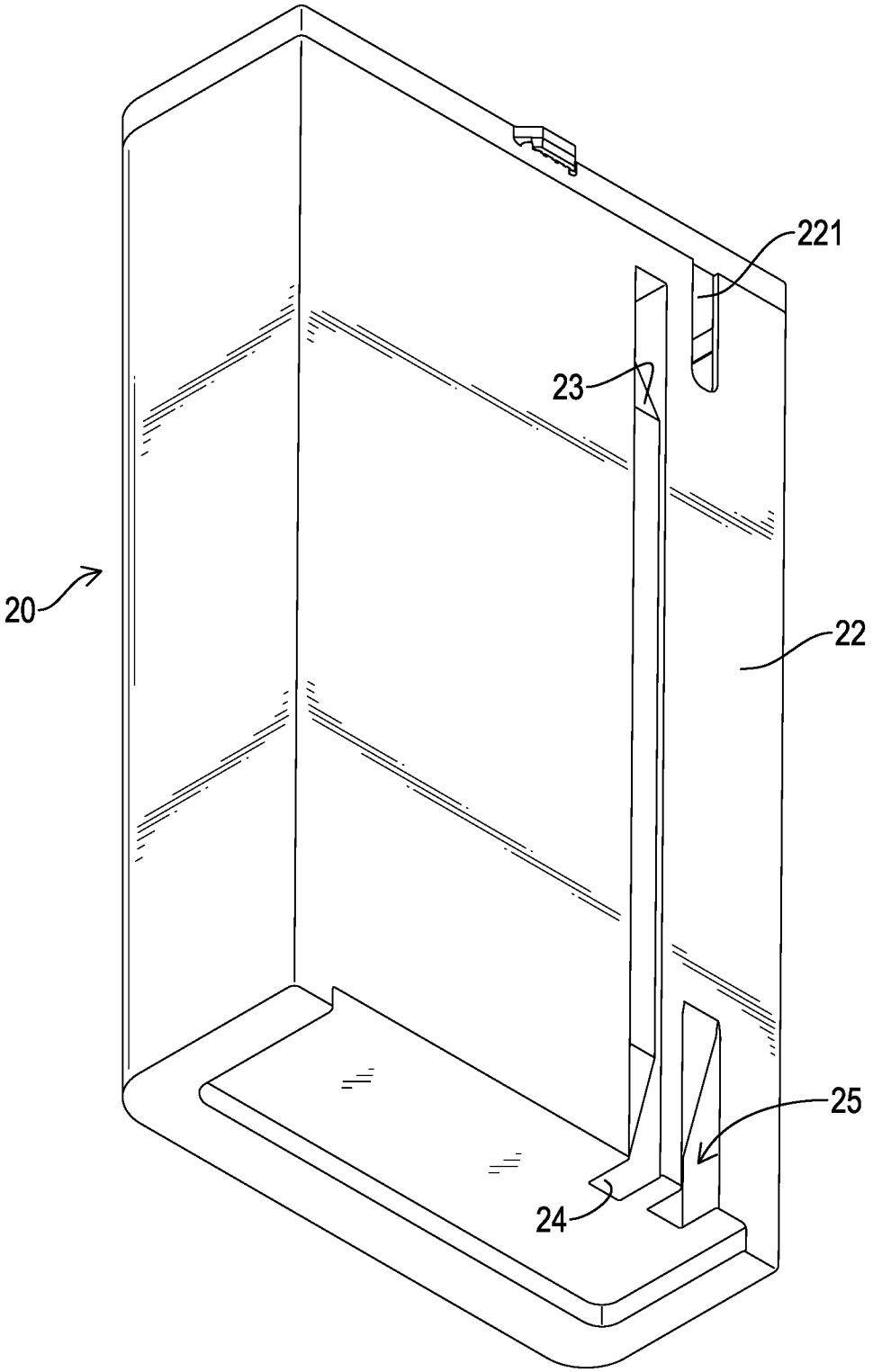
FIG. 9 is a perspective view of the main tank in FIG. 1.

The first inclined portion 23 is formed on the third surface of the side wall 22 and is bottom-up progressively away from the partition wall 15. When the main tank 20 is mounted on the main body 10, the first inclined portion 23 corresponds in location to the abutting portion 1731 that runs through the partition wall 15. While the main tank 20 is moved upward with respect to the main body 10, the first inclined portion 23 abuts the abutting portion 1731 and slides on the abutting portion 1731, so that the first inclined portion 23 pushes the retractable component 173 away from the partition wall 15 and thereby the conduit portion 1732 is progressively retracted from the main storage space 21 and the through hole 221. The interaction of the first inclined portion 23 and the abutting portion 1731 is shown in FIG. 5 and FIG. 7 and the interaction of the through hole 221 and the conduit portion 1732 is shown in FIG. 6 and FIG. 8. Besides, FIG. 5 and FIG. 6 depict that the main tank 20 is mounted on the main body 10 and FIG. 7 and FIG. 8 depict the moment when the main tank 20 is being detached from the main body 10.

The second inclined portion 24 is also formed on the third surface of the side wall 22 and is bottom-up progressively closer to the partition wall 15. The second inclined portion 24 is located under and aligned with the first inclined portion 23. When the main tank 20 is being moved downward with respect to the main body 10, the second inclined portion 24 abuts the abutting portion 1731 and slides on the abutting portion 1731, so that the second inclined portion 24 pushes the retractable component 173 away from the partition wall 15 and thereby the conduit portion 1732 is progressively retracted toward the first surface of the partition wall 15.

The retracting recess 25 is formed on the third surface of the side wall 22. When the main tank 20 is moved downward with respect to the main body 10 and the second inclined portion 24 abuts the abutting portion 1731, the retracting recess 25 is capable of receiving the conduit portion 1732.

In the process of installing the main tank 20 on the main body 10, the second inclined portion 24 should be moved to abut the abutting portion 1731 first, and then the main tank 20 is moved downward. Initially, the conduit portion 1732 is received in the retracting recess 25, but after the main tank 20 is moved downward, the second inclined portion 24 pushes the conduit portion 1732 out of the retracting recess 25 and toward the first surface of the partition wall 15. Thus, the conduit portion 1732 leaves from the moving path of the main tank 20 such that the main tank 20 is capable of being moved downward. The main tank 20 keeps moving downward until the first inclined portion 23 abuts the abutting portion 1731, because the first inclined portion 23 is also moved downward with respect to the abutting portion 1731, a portion, which is farther from the partition wall 15, of the first inclined portion 23 abuts the abutting portion 1731. At the same time, the elastic component 174 is pushing the retractable component 173 toward the partition wall 15 so the abutting portion 1731 of the retractable component 173 progressively protrudes out of the partition wall 15, and the conduit portion 1732 of the retractable component 173 progressively runs through the through hole 221 and then into the main storage space 21.

Figure 10:
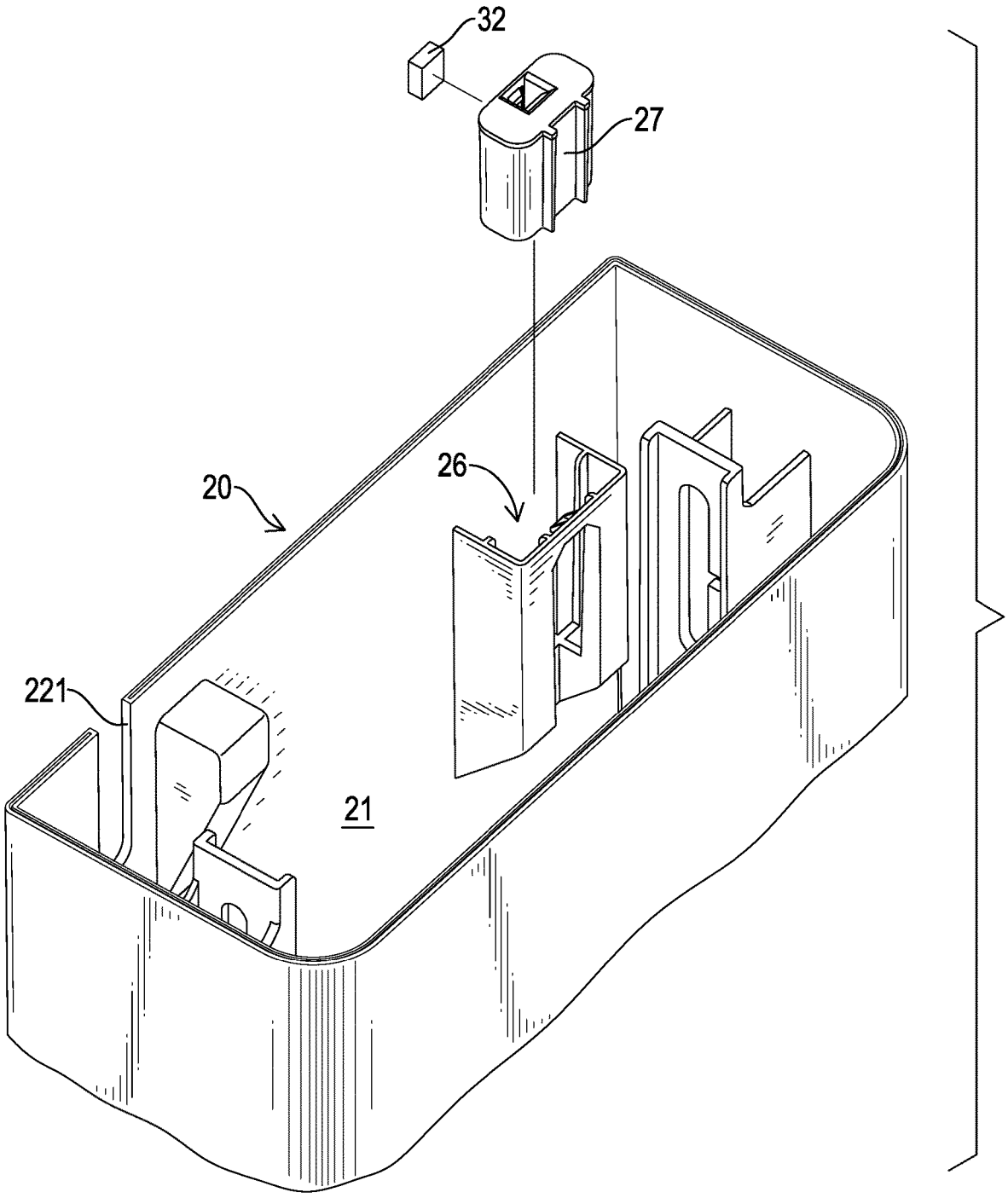
FIG. 10 is an exploded view of the main tank in FIG. 1.
Figure 11:
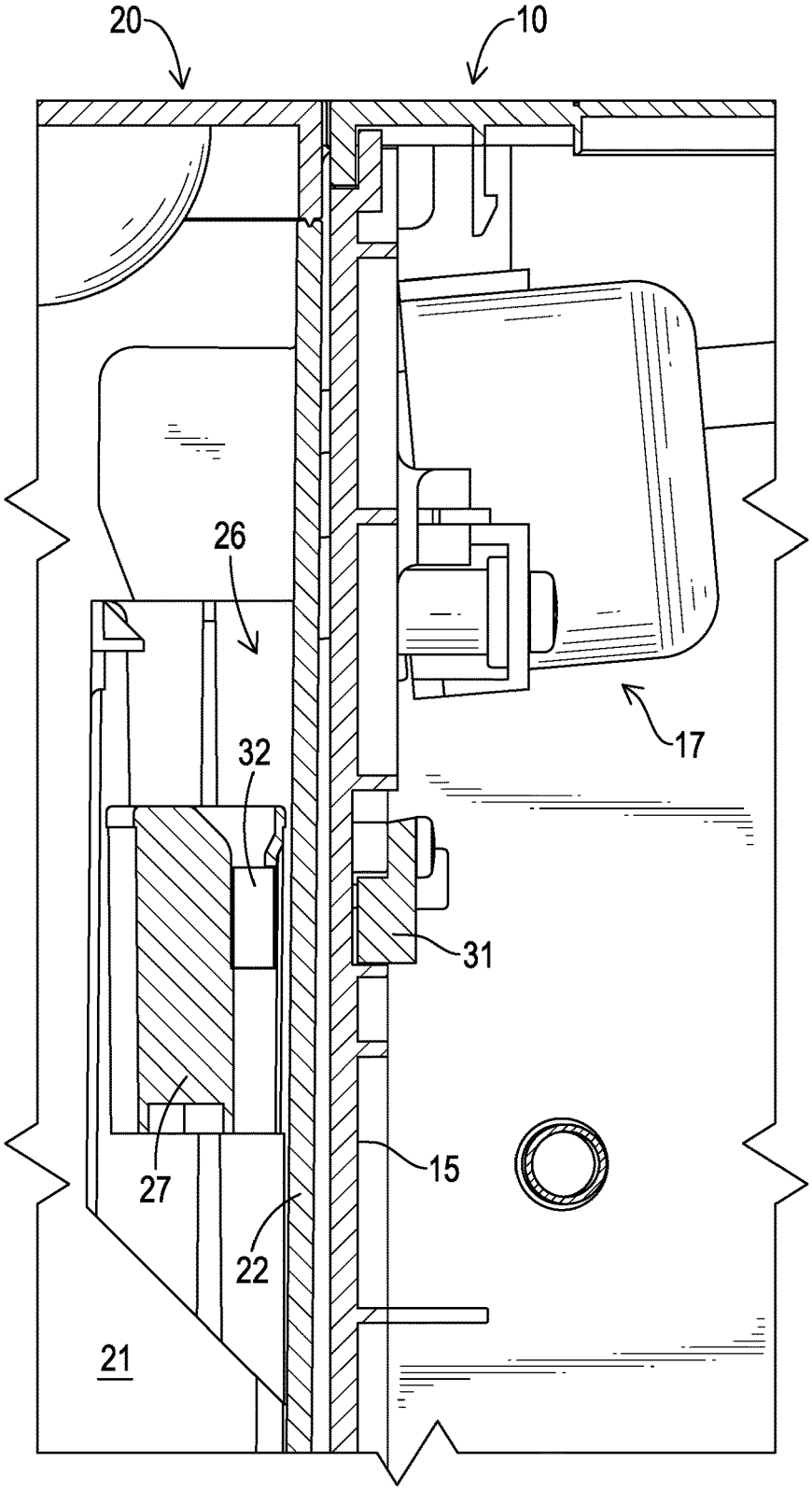
FIG. 11 is a sectional view of a first detection component and a second detection component of the dehumidifier in FIG. 1.

Then please also refer to FIG. 10 and FIG. 11. In this embodiment, the main tank 20 further includes a guiding groove 26 and a float ball 27, and the dehumidifier with a retractable conduit further includes a first detection component 31 and a second detection component 32.

The guiding groove 26 is located at the side wall 22, located in the main storage space 21, and extends up and down. The float ball 27 is capable of being moved in the guiding groove 26. The guiding groove 26 communicates with the main storage space 21 and thus water in the main storage space 21 can flow into the guiding groove 26, such that the float ball 27 is capable of being moved up and down according to the level of the water in the main storage space 21. The first detection component 31 is mounted on the partition wall 15. The second detection component 32 is mounted on the float ball 27 and the location thereof selectively corresponds to the first detection component 31. Precisely, because the second detection component 32 is mounted on the float ball 27, the second detection component 32 may be moved up and down according to the water level in the main storage space 21 with the float ball 27. Thus, the second detection component 32 selectively corresponds to the first detection component 31 in location, so the first detection component 31 can react according to the location of the second detection component 32. For example, when the water level in the main storage space 21 rises such that the second detection component 32 is moved to correspond to the first detection component 31, the first detection component 31 may detect that the second detection component 32 is getting closer, then the first detection component 31 sends a signal to the pump 14 to stop to draw water into the main tank 20, thereby avoiding overflow of the main tank 20.

Consequently, with the secondary tank 13 is located under the water collector 12, the secondary tank 13 can temporarily store the water collected by the water collector 12. With the conduit portion 1732 passing through the through hole 221 of the side wall 22 and into the main storage space 21, and with the drawing end 141 of the pump 14 communicating with the secondary tank 13 and the draining end 142 of the pump 14 and the draining end 142 of the pump 14 communicating with the conduit portion 1732, the pump 14 can draw the water from the secondary tank 13 to the main tank 20. Therefore, the main tank 20 may not be restricted by the gravity which restricts the main tank 20 to be mounted at a lower end of a dehumidifier. As a result, the main tank 20 can be mounted beside the main body 10 and can be extracted with a vertical force, so the present invention facilitates ease in operating, avoids the main tank 20 to be turned over, and avoids injuring a user's waist.

Moreover, with the first inclined portion 23 formed on the third surface of the side wall 22, and with the first inclined portion 23 corresponding to the abutting portion 1731, when the user lifts up the main tank 20 to move upward with respect to the main body 10, the first inclined portion 23 can abut the abutting portion 1731 and slide with respect to the abutting portion 1731. Because the first inclined portion 23 is bottom-up progressively away from the partition wall 15, when the first inclined portion 23 is moving upward with respect to the abutting portion 1731, the first inclined portion 23 progressively abuts the abutting portion 1731 via a portion thereof that is closer to the partition wall 15. In other words, because the first inclined portion 23 abuts the abutting portion 1731, the retractable component 173 is moved away from the partition wall 15, and thereby the conduit portion 1732 is moved out of the main storage space 21 and the through hole 221. Therefore, after the main tank 20 is mounted on the main body 10, the conduit portion 1732 can be located in the main tank 20 and moved away from the moving path of the main tank 20 when the main tank 20 is separating from the main body 10.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A dehumidifier including:

a main body including:

a radiator;

a water collector located under and aligned with the radiator and forming:

an exhaust hole;

a secondary tank located under the water collector and forming:

a receiving hole aligned with the exhaust hole; and a secondary storage space communicating with the receiving hole;

a pump including:

a drawing end communicating with the secondary storage space; and a draining end;

a partition wall including:

a first surface; and a second surface opposite the first surface; and a retracting mechanism including:

a retractable component movably mounted on the first surface of the partition wall and including:

an abutting portion selectively passing through the partition wall; and a conduit portion selectively passing through the partition wall; the conduit portion communicating with the draining end of the pump; and an elastic component connected to the retractable component to facilitate the abutting portion and the conduit portion to pass through and out of the partition wall; and a main tank detachably mounted on the main body and located beside the second surface of the partition wall of the main body; the main tank capable of being moved upward with respect to the main body, thereby being detached from the main body; the main tank including:

a main storage space;

a side wall facing the partition wall of the main body and including:

a third surface facing the partition wall; and a through hole communicating with the main storage space; the conduit portion of the retractable component selectively passing through the through hole and into the main storage space; and a first inclined portion formed on the third surface of the side wall; the first inclined portion being bottom-up progressively away from the partition wall; wherein when the main tank is moved upward with respect to the main body and the first inclined portion abuts the abutting portion of the retractable component, the first inclined portion pushes the abutting portion of the retractable component away from the partition wall and thereby the conduit portion of the retractable component is progressively retracted from the main storage space and the through hole of the main tank.

2. The dehumidifier as claimed in claim 1, wherein:

the retracting mechanism further includes:

a housing mounted on the first surface of the partition wall; the housing including:

an inner space; and a communicating opening communicating with the inner space and facing the partition wall;

the retractable component of the retracting mechanism is movably mounted in the inner space; and the elastic component of the retracting mechanism connects the housing and the retractable component, thereby facilitating the abutting portion and the conduit portion of the retractable component to pass through and out of the communicating opening.

3. The dehumidifier as claimed in claim 2, wherein:

the retracting mechanism further includes:

a positioning component mounted on the housing and located in the inner space; and the retractable component of the retracting mechanism is sleeved on the positioning component and is capable of moving along the positioning component.

4. The dehumidifier as claimed in claim 1, wherein a moving path of the retractable component of the retracting mechanism is straight and is oblique relative to the partition wall.

5. The dehumidifier as claimed in claim 3, wherein a moving path of the retractable component of the retracting mechanism is straight and is oblique relative to the partition wall.

6. The dehumidifier as claimed in claim 4, wherein the moving path is inclined downwardly in a direction toward the partition wall.

7. The dehumidifier as claimed in claim 5, wherein the moving path is inclined downwardly in a direction toward the partition wall.

8. The dehumidifier as claimed in claim 1, wherein the main tank further includes:

a second inclined portion formed on the third surface of the side wall and located under and aligned with the first inclined portion; the second inclined portion being bottom-up progressively closer to the partition wall; wherein when the main tank is moved downward with respect to the main body and the second inclined portion of the main tank abuts the abutting portion of the retractable component, the second inclined portion slides with respect to the abutting portion and the second inclined portion pushes the abutting portion of the retractable component away from the partition wall and thereby the conduit portion of the retractable component is progressively retracted from a moving path of the main tank; and a retracting recess formed on the third surface of the side wall; wherein when the main tank is moved downward with respect to the main body and the second inclined portion of the main tank abuts the abutting portion of the retractable component, the conduit portion of the retractable component is received in the retracting recess.

9. The dehumidifier as claimed in claim 7, wherein the main tank further includes:

a second inclined portion formed on the third surface of the side wall and located under and aligned with the first inclined portion; the second inclined portion being bottom-up progressively closer to the partition wall; wherein when the main tank is moved downward with respect to the main body and the second inclined portion of the main tank abuts the abutting portion of the retractable component, the second inclined portion slides with respect to the abutting portion and the second inclined portion pushes the abutting portion of the retractable component away from the partition wall and thereby the conduit portion of the retractable component is progressively retracted from a moving path of the main tank; and a retracting recess formed on the third surface of the side wall; wherein when the main tank is moved downward with respect to the main body and the second inclined portion of the main tank abuts the abutting portion of the retractable component, the conduit portion of the retractable component is received in the retracting recess.

10. The dehumidifier as claimed in claim 1, wherein:

the main body further includes:

an enclosing wall connected to the second surface of the partition wall; the enclosing wall and the partition wall enclosing a receiving space therebetween; and the main tank is upwardly detachably mounted in the receiving space.

11. The dehumidifier as claimed in claim 9, wherein:

the main body further includes:

an enclosing wall connected to the second surface of the partition wall; the enclosing wall and the partition wall enclosing a receiving space therebetween; and the main tank is upwardly detachably mounted in the receiving space.

12. The dehumidifier as claimed in claim 1, wherein:

the main tank further includes:

a guiding groove formed on the side wall, extending up and down, and located in the main storage space; the guiding groove communicating with the main storage space; and a float ball movably mounted in the guiding groove; and the dehumidifier further includes:

a first detection component mounted on the partition wall of the main body; and a second detection component mounted on the float ball of the main tank;

wherein either the first detection component or the second detection component is configured to detect the other.

13. The dehumidifier as claimed in claim 11, wherein:

the main tank further includes:

a guiding groove formed on the side wall, extending up and down, and located in the main storage space; the guiding groove communicating with the main storage space; and a float ball movably mounted in the guiding groove; and the dehumidifier further includes:

a first detection component mounted on the partition wall of the main body; and a second detection component mounted on the float ball of the main tank;

wherein either the first detection component or the second detection component is configured to detect the other.

* * * * *